US005495820A

United States Patent [19]

Seron

[11] Patent Number: 5,495,820

[45] Date of Patent: Mar. 5, 1996

[54] WHISTLE WITH TONE CHANGING ROTATOR

[75] Inventor: Suren V. Seron, Minooka, Ill.

[73] Assignee: Seron Manufacturing Company, Joliet, Ill.

[21] Appl. No.: 317,373

[22] Filed: Oct. 4, 1994

[51] Int. Cl.[6] ..... G10K 5/00; A63H 5/00

[52] U.S. Cl. ..... 116/137 R; 116/140; 446/206

[58] Field of Search ..... 116/137 R, 140, 116/141; 84/330, 378; 446/204, 205, 206, 208, 216, 207

[56] References Cited

U.S. PATENT DOCUMENTS

| | | | |
|---|---|---|---|
| 2,755,696 | 7/1956 | Legler | 446/208 |
| 2,915,851 | 12/1959 | Ringman | 446/206 |
| 3,327,579 | 6/1967 | Brimhall | 84/330 |
| 5,113,784 | 5/1992 | Forselius | 116/137 R |
| 5,251,569 | 10/1993 | Seron . | |
| 5,287,785 | 2/1994 | Miller | 446/206 |

FOREIGN PATENT DOCUMENTS

| | | | |
|---|---|---|---|
| 2048543 | 12/1980 | United Kingdom | 116/140 |

*Primary Examiner*—William A. Cuchlinski, Jr.
*Assistant Examiner*—Andrew Hirshfeld
*Attorney, Agent, or Firm*—Wood, Phillips, VanSanten, Clark & Mortimer

[57] ABSTRACT

A whistle including a body (10) having a resonating chamber (28) and a mouth piece (12) connected thereto includes a plurality of tone altering apertures (36) which extend to the chamber (28). A closure (40) is movably mounted on the body (10) between positions closing one, some or all of the tone altering apertures (36) so that the tone of the whistle may be selectively altered by selectively positioning the closure (40) in a desired one of its positions.

13 Claims, 1 Drawing Sheet

WHISTLE WITH TONE CHANGING ROTATOR

FIELD OF THE INVENTION

This invention relates to whistles.

BACKGROUND OF THE INVENTION

In my prior U.S. Pat. No. 5,251,569, dated Oct. 12, 1993, the details of which are herein incorporated by reference, there is disclosed a multiple tone whistle. A whistle resonating chamber is in fluid communication with the mouth piece and has an opening to the exterior of the whistle body. Knock outs are provided in the whistle body and extend to the resonating chamber. When a knock out is removed, it creates a pitch altering opening to the resonating chamber. The greater the desired variation from the original tone, the greater the number of knock outs that are removed.

Such a whistle works extremely well for its intended purpose, particularly when employed in the environment a whistle having two distinct resonating chambers. By altering the tone of one resonating chamber with respect to the other, the resulting sound may be made to range from an extremely strident tone to a tone of two pitches essentially in harmony with one another.

However, once the whistle tone is selected by removing one or more of the knock outs, it is not particularly practical to return to or towards the original tone. Of course, one could use an object such as a piece of tape to cover one of the opened tone altering openings whose knock out has been removed, but that is not the most practical in that such a piece of tape can easily become disassociated from the whistle or become punctured. In such a case, the original tone of the whistle cannot be maintained.

The present invention is directed to overcoming one or more of the above problems.

SUMMARY OF THE INVENTION

It is the principal object of the invention to provide a new and improved whistle. More particularly, it is an object of the invention to provide a whistle whose tone or pitch may be selectively altered and, when desired, restored or further altered.

An exemplary embodiment of the invention achieves the foregoing object in a whistle that includes a whistle body having a resonating chamber and a mouth piece connected thereto. The mouth piece has a duct extending to the chamber so that air under pressure may be introduced into the chamber. A sounding aperture is located in the body and extends to the chamber.

A plurality of tone altering apertures are located in the body and extend to the chamber. A closure is movably mounted on the body and is movable between positions closing one, some or all of the tone altering apertures. As a consequence, the tone of the whistle may be selectively altered by selectively positioning the closure in a desired one of the positions.

In a preferred embodiment, cooperating detent means are provided on the closure and the whistle body for releasably holding the closure in a selected one of its positions.

In one embodiment of the invention, the detent means includes a projection and at least one recess for receiving the projection.

In a preferred embodiment, the projection is on the closure and the recess is on the body.

According to the invention, the closure is preferably a disc-like element rotatable on the body.

In a highly preferred embodiment, the disc-like element includes a slot in an exterior surface thereof for receiving a twisting force from, for example, a coin or the like.

In a highly preferred embodiment, the resonating chamber has a generally cylindrical wall and the tone altering apertures are in the cylindrical wall. The disc-like element includes a partial peripheral flange that is co-planar with the tone altering apertures so that rotation of the disc-like element will bring the flange into overlying relation with one or more of the apertures to close the same.

In a highly preferred embodiment, the body includes a cap closing an end of the chamber and the disc-like element is journalled in the body by the cap.

In a preferred embodiment of the invention, the chamber is generally cylindrical and has an enlarged step at an end thereof. The disc-like element has a first cylindrical surface received in an opening in the cap and a second, at least partial cylindrical surface of larger diameter than the first cylindrical surface received in the step.

Preferably, the tone altering apertures open to the step and the second surface defines the closure. In one embodiment of the invention, the body contains two of the resonating chambers. Stop surfaces may also be provided to limit movement of the closure.

Other objects and advantages will become apparent from the following specification taken in connection with the accompanying drawings.

DESCRIPTION OF THE PREFERRED EMBODIMENT

Figure 1:
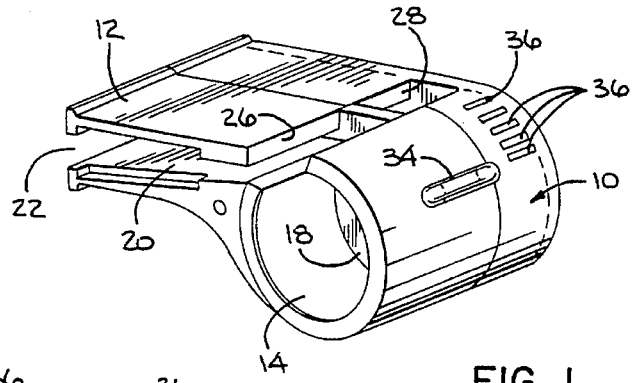
FIG. 1 is a perspective view of a whistle made according to the invention with an end cap removed therefrom.
Figure 2:
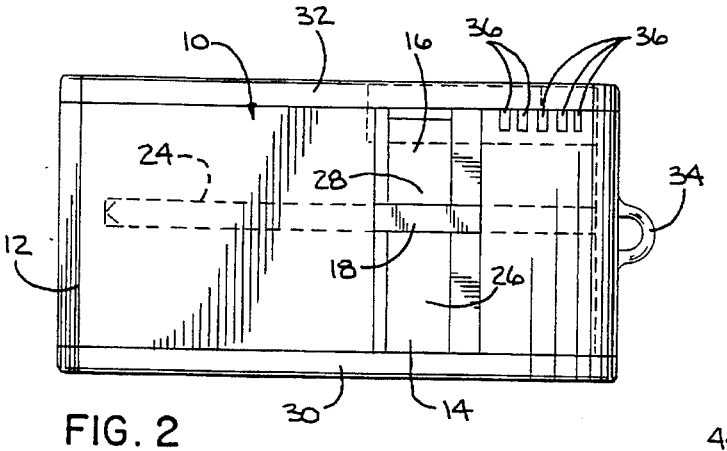
FIG. 2 is a plan view of the whistle.

An exemplary embodiment of the invention is illustrated in the drawings and with reference to FIGS. 1 and 2 includes a whistle body, generally designated 10. The whistle body 10 includes a mouth piece 12 and two, generally cylindrical resonating chambers 14 and 16 which are separated by a generally central wall 18. A duct 20 in the mouth piece 12 extends from a mouth piece opening 22 to the chamber 14, 16 and is divided into two components by a continuation 24 (FIG. 2) of the wall 18.

A pair of sounding openings 26 and 28 of conventional configuration extend to the chambers 14 and 16 respectively.

As described in greater detail in my previously identified patent, the body 10 includes end caps 30 and 32. The manner in which the end caps 30 and 32 are formed and attached to the remainder of the body 10 may be ascertained from my previously identified patent.

The body 10 may be provided with an integral loop 34 whereby the whistle may be attached to a lanyard or the like.

The body 10 also includes a plurality of tone altering apertures 36. The apertures 36 extend through the wall of the body 10 to the chamber 16 to be in fluid communication therewith. Unlike the corresponding apertures in my prior patent, the apertures 36 do not include knock outs.

If desired, the apertures 36 could be in communication with the chamber 14. Alternatively, it is also possible that apertures 36 could be provided for both of the chambers 14 and 16.

Figure 3:
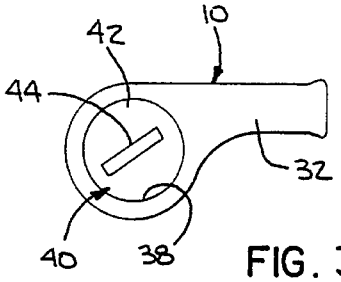
FIG. 3 is a side elevation of the whistle.

Turning now to FIGS. 3–6, the end cap 32 is illustrated in FIG. 3 and is seen to include a circular opening 38 whose center is on the center of the chamber 16 which, it will be recalled, is cylindrical. Journalled within the aperture 38 is a closure, generally designated 40. The closure 40 is in the shape of a disc-like element and on an exterior surface 42 thereof includes an elongated slot 44. The slot 44 is adapted to receive a twisting force. For example, the tip of a knife, the end of screwdriver or an edge of a coin could be inserted in the slot 44 so as to rotate the closure 40 within the opening 38.

Figure 4:
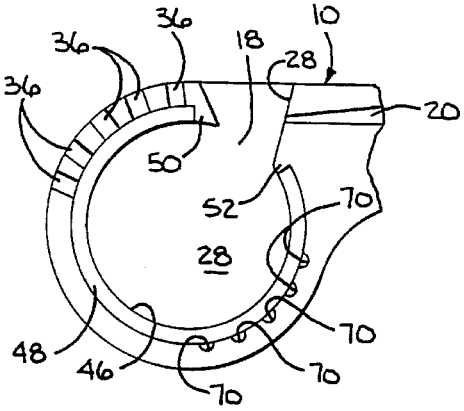
FIG. 4 is an enlarged, fragmentary view of one side of the whistle with an end cap removed therefrom.

Looking specifically at FIG. 4, whistle body 10 with the cap 32 removed is seen. The cylindrical wall 46 of the resonating cavity 16 includes an enlarged, cylindrical step 48 at its end thereof remote from the partition 18. The step 48 is not completely cylindrical in that, at both sides of the sounding aperture 28, there are located inwardly extending projections 50 and 52. The projections 50 and 52 act as stops as will be seen.

It is also significant to note from FIG. 4 that the tone altering apertures open to the step 48 and as can be ascertained from FIG. 2, are in the form of notches whose open ends are closed when the cap 32 is applied as part of the whistle body 10.

Figure 5:
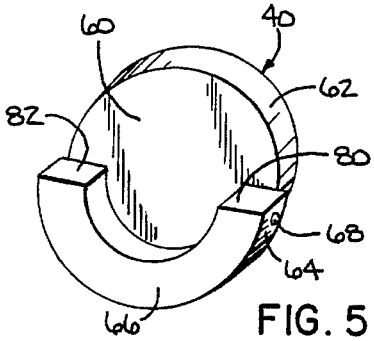
FIG. 5 is a perspective view of a closure used in the whistle.
Figure 6:
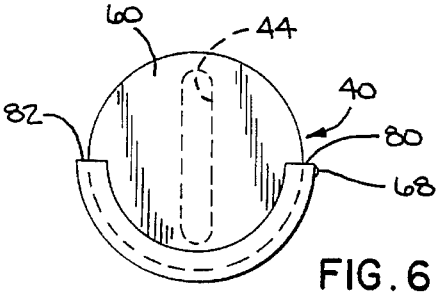
FIG. 6 is a side elevation of the closure.

Looking specifically at FIGS. 5 and 6, the closure 40 has an internal surface 60. It also includes a first cylindrical surface 62 which is of a diameter just slightly less than the diameter of the opening 38. The first cylindrical surface 62 is received in the opening 38 to journal the closure 40 to the body 10.

The closure 40 also includes a second, partial cylindrical surface 64 on the exterior of a partial peripheral flange 66. The cylindrical surface 64 has a larger diameter than the diameter of either the cylindrical surface 62 or the opening 38. The diameter of the cylindrical surface 64 is just slightly less than that of the step 48.

In a preferred embodiment, the arcuate extent of the cylindrical surface 64 is approximately 180° and includes a small projection 68 which forms part of a detent.

Turning to FIG. 4, the step 48 is provided with a series of recesses 70 which are adapted to receive the projection 68. The recesses 70 are located appropriately with respect to the tone altering apertures 36 such that each recess 70 provides a detent action for each of approximately five different positions of the closure 40 within the opening 38 in the cap 32. Thus, the closure 40 may be rotated as desired to move the second cylindrical surface 64 to uncover one or more of the tone altering apertures 36 and to be held in that position by reason of the projection 68 entering a corresponding one of the recesses 70.

The peripheral flange 66 also includes end surfaces 80 and 82. When the closure is installed in the body 10 with the cap 32 in place, it will be appreciated that clockwise rotation as viewed in FIG. 4 will be limited by engagement of the surface 80 with the stop 50 while counter-clockwise rotation will be limited by engagement of the surface 82 with the stop 52.

It will also be appreciated that because the opening 38 is approximately of the same diameter as the cylindrical surface 62 while the surface 64 is a larger diameter, the latter acts as a means to hold the closure 40 within the cap 32. Thus, this configuration causes the cap 32 to journal the closure 40 within the step 48 with the surface 64 in the same plane as the apertures 36.

From the foregoing, it will be appreciated that a whistle made according to the invention may selectively have its tone or pitch altered simply by rotating the closure 40 to a desired one of several positions. If it is desired to restore the whistle to an original tone, that is accomplished simply by rotating the closure 40 back to its original or other desired position. Thus, in whistle made according to the invention, tone altering is not a more or less permanent operation as is the case with my prior whistle.

I claim:

1. A whistle comprising:

a whistle body including a resonating chamber and a mouth piece connected thereto, said mouth piece having a duct extending to said chamber so that air under pressure may be introduced into said chamber, and a sounding aperture in said body and extending to said chamber;

a plurality of tone altering apertures in said body and extending to said chamber; and a closure movably mounted on said body and movable between positions closing one, some and all of said tone altering apertures, said closure not blocking said sounding aperture when said closure is in any one of said positions;

whereby the tone of said whistle may be selectively altered by selectively positioning said closure in a desired one of said positions.

2. The whistle of claim 1 further including cooperating detent means on said closure and on said body for releasably holding said closure in a selected one of said positions.

3. The whistle of claim 2 wherein said detent means includes a projection and at least one recess for receiving said projection.

4. The whistle of claim 3 wherein said projection is on said closure and said recess is on said body.

5. The whistle of claim 1 wherein said closure includes a disc-like element rotatable on said body.

6. The whistle of claim 5 wherein said disc-like element includes a slot in an exterior surface thereof for receiving a twisting force.

7. The whistle of claim 5 wherein said resonating chamber has a generally cylindrical wall and said tone alternating apertures are in said cylindrical wall; and said disc-like element includes a partial peripheral flange that is co-planar with said tone altering apertures, whereby rotation of said disc-like element will bring said flange into overlying relation with at least one of said apertures.

8. The whistle of claim 5 wherein said body includes a cap closing an end of said chamber and said disc-like element is journalled in said body by said cap.

9. The whistle of claim 8 wherein said chamber is generally cylindrical and has an enlarged step at said end thereof, said disc-like element having a first cylindrical surface received in an opening in said cap and a second, at least partial cylindrical surface of larger diameter than said first cylindrical surface received in said step.

10. The whistle of claim 9 wherein said tone altering apertures open to said step and said second surface defines said closure.

11. The whistle of claim 9 further including spaced stop surfaces on said step.

12. The whistle of claim 1 further including stop surfaces on said body for limiting movement of said closure.

13. The whistle of claim 1 wherein said body further includes a second resonating chamber.

* * * * *